US005408749A

United States Patent [19]

Momose

[11] Patent Number: 5,408,749

[45] Date of Patent: Apr. 25, 1995

[54] ELECTRIC RAZOR

[75] Inventor: Kazuhiro Momose, Nagano, Japan

[73] Assignee: Izumi Products Company, Nagano, Japan

[21] Appl. No.: 163,379

[22] Filed: Dec. 7, 1993

[30] Foreign Application Priority Data

Feb. 12, 1993 [JP] Japan ..... 5-024380

[51] Int. Cl.[6] ..... B26B 19/16

[52] U.S. Cl. ..... 30/43.6; 30/347

[58] Field of Search ..... 30/43.4, 43.5, 43.6, 30/346.55, 346.57

[56] References Cited

U.S. PATENT DOCUMENTS

| | | | |
|---|---|---|---|
| 2,824,367 | 2/1958 | McWilliams | 30/43.6 |
| 3,089,236 | 5/1963 | Galvao | 30/43.6 |
| 3,261,091 | 7/1966 | Van Den Driest | 30/43.6 |
| 3,710,442 | 1/1973 | Meyer | 30/43.6 |
| 4,281,453 | 8/1981 | Bakker et al. | 30/43.6 |

FOREIGN PATENT DOCUMENTS

| | | | |
|---|---|---|---|
| 2109738 | 6/1983 | United Kingdom | 30/346.55 |

*Primary Examiner*—Hwei-Siu Payer
*Attorney, Agent, or Firm*—Koda and Androlia

[57] ABSTRACT

An electric rotary razor including at least one outer cutter which has slits for whisker entry and at least one inner cutter having a plurality of cutter blades. Each one of the cutting blades is inclined in the rotational direction of the inner cutter and has a cutting edge surface at its upper end that slide on the bottom surface of the outer cutter. The cutting edge surface is thinner than the cutter blade or the cutter blade can have a recess beneath the cutting edge surface. Thus, sheared whiskers are prevented from sticking to the cutter blade of the inner cutter.

3 Claims, 3 Drawing Sheets

ELECTRIC RAZOR

BACKGROUND OF THE INVENTION

1. Field of the Invention

The present invention relates to an electric razor and more particularly to an electric razor that includes an inner rotary cutter which can reduce the load and frictional resistance relative to the power source and outer cutter.

2. Prior Art

In rotary electric razors, the inner cutters are rotated under the outer cutters, and the whiskers are cut by the shearing force provided by the outer and inner cutters. There is an electric razor having a single shaving unit that consists of a single inner cutter and a single outer cutter installed in a head frame of a razor. There is also another type of electric razor that has three shaving units arranged in an equilateral triangle shape on a head frame.

FIG. 8 illustrates the relationship between the outer cutter and the inner cutter. The explanation of the cutters will be made below referring to how the whiskers are cut by the cutters.

More specifically, the outer cutter 2 has openings or slits 2*a* on the top surface. Whiskers penetrate the slits 2*a* into the razor and are cut by the sliding action of cutter blades 4*a* (only one shown in this Figure) of the inner cutter 4 which is in contact with the outer cutter 2 and rotates in the direction of the arrow. In other words, the whiskers are cut by the outer cutter 2 and the rotating inner cutter 4. The cutter blades 4*a* of the inner cutter 4 are inclined in the rotational direction of the inner cutter.

There are different types of inner cutters. One of them is an inner cutter obtained by cutting and bending a plurality of projections from the circumferential edge portion of a cutter disk that is made out of metal or other materials.

When shaving is done, grease secreted out of the skin is mixed with shaving debris of the sheared whiskers. As a result, the shaving debris easily adheres to the surfaces of the cutter blade, particularly to the rear side surface 4*b* of the cutter blade 4*a* that faces the opposite direction from the direction of the rotation of the inner cutter. More specifically, if the shaving debris 5 and other substances adhere to the cutter blades, the frictional resistance between the inner cutter and outer cutter increases. This means that the load applied on the driving source (or motor) increases, resulting in high power consumption. Moreover, the rotational speed of the inner cutter goes down and the cutting or shaving performance drops. Thus, cleaning of the inner cutter 4 is inevitable.

Furthermore, when the frictional resistance between the inner and outer cutters is increased, heat is generated, which imparts an unpleasant sensation to the skin. In addition, the generation of heat accelerates wear in the inner and outer cutters and may damage them eventually.

In a conventional electric razor, a spring is used so that the cutter blades, or its tip ends, of the inner cutter are urged so as to keep contact with the inner or bottom surface of the outer cutter. In this structure, if the area of contact between the outer and inner cutters is large, a large load is proportionally applied on the inner cutter, and this causes the increase of power consumption.

In the inner cutter which has cutter blades integral with a metal cutter disk, the cutter blades are obtained, as described above, by cutting and bending the circumferential edge portion of a round metal disk. Thus, the thickness of the cutter disk will be the thickness of the cutter blade, which is referred to by A in FIG. 8. As a result, it is necessary that a cutter disk be as thin as possible so as to obtain thin cutter blades in order to keep the friction between the inner and outer cutters as small as possible. When, however, the cutter disk as a whole is thin, the overall strength of the cutter blades is impaired. In other words, in conventional inner cutters, the reduction in the thickness of the cutter blade and the assurance of the overall strength of the cutter blades is in conflict and has been unsolved.

SUMMARY OF THE INVENTION

Accordingly, one object of the present invention is to provide an electric razor which can minimize the contact pressure of the inner cutter against the inside or bottom surface of the outer cutter by securing a reduced amount of surface area of the inner cutter that is in contact with the outer cutter.

It is another object of the present invention to provide an electric razor which assures that the shaving debris and other substances do not easily adhere to the cutter blades of the inner cutter.

These objects are accomplished for an electric razor which includes at least one outer cutter having openings or slits opened in the top surface through which the whiskers penetrate and at least one rotatable inner cutter which, in cooperation with the outer cutter, cuts the whiskers and has a plurality of cutter blades inclined in the direction of rotation; and a unique structure for the razor is that the cutter blades is provided with a cutting edge surface at the end surface that slides on the inner or bottom surface of the outer cutter and the cutting edge surface is formed to be small in thickness.

In order to accomplish the objects, the rear portion of the cutting edge surface (or the portion which faces a direction opposite to the rotational direction of the inner cutter) is cut out. It is also possible to form a recess of a great amount of indentation on the upper rear surface of the cutter blade so that the recess is located immediately beneath the rear edge of the cutting edge surface that is on the opposite side from the direction of rotation of the inner cutter.

With the structure described above, the load which the inner cutter bears is small because the thickness of the cutting edge surface in the direction of rotation is small and therefore the contact area between the outer cutter and the cutting edge surface of the inner cutter is small.

In addition, with the greatly indented recess formed immediately beneath the cutting edge surface of the cutter blade, the shaving debris and other substances are not likely to adhere to the surface of the inner cutter including the cutter blades and the cutting edge surfaces.

DETAILED DESCRIPTION OF THE INVENTION

One embodiment of the present invention will be described below in detail with reference to the accompanying drawings.

Figure 1:
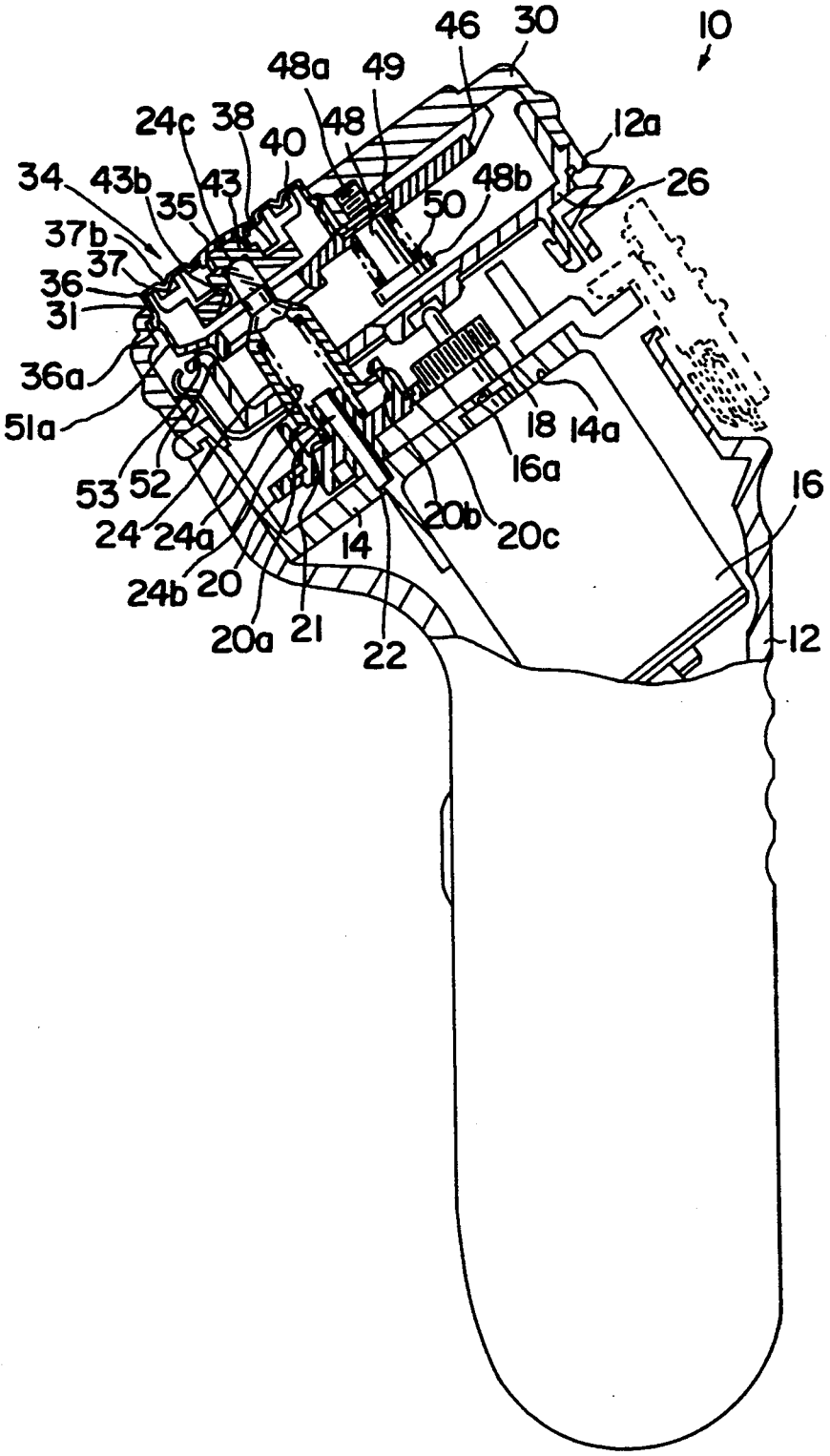
FIG. 1 is a cross-sectional diagram of the head portion of the electric razor according to the present invention.

In FIG. 1, reference numeral 12 is the housing of an electric razor 10. The housing 12 has an opening 12*a* at the upper end, and a fixing frame 14 is inserted into the housing 12 through this opening 12*a* and fixed inside the housing 12. A motor 16 is mounted to the undersurface of the fixing frame 14. The axle 16*a* of the motor 16 protrudes through a hole 14*a* of the fixing frame 14, and a drive gear 18 is coupled to the motor axle 16*a*.

Three transmission gears 20 (only one is shown) are rotatably supported on the fixing frame 14 and engage with the drive gear 18. These transmission gears 20 are arranged in an equilateral triangle configuration, and drive shafts 24 (only one is shown) are engaged with the transmission gears 20. Since all three transmission gears 20 have the same structure, only one transmission gear 20 and its related elements will be described below.

The transmission gear 20 includes a shaft tube 20*a* which is rotatably fitted on a shaft 22 provided on the fixing plate 14. A coil spring 21 is provided on the shaft tube 20*a*. The lower portion of the spring 21 is positioned on the shaft tube 20*a*, and the upper portion of the spring 21 is set inside the inner tube 24*a* of the drive shaft 24. Thus, the drive shaft 24 is urged upward (in the drawing) by the spring 21. The drive shaft 24 has a flange 24*b* around the lower end, and this flange 24*b* is positioned inside a guide tube 20*b* of the transmission gear 20. The drive shaft 24 is prevented from slipping relative to the transmission gear 20 by a claw 20*c* formed on the inner surface of the guide tube 20*b*. The flange 24*b* of the drive shaft 24 is engaged with the guide tube 20*b* so that the transmission gear 20 and the drive shaft 24 are rotated together. As an example of this engagement of the drive shaft 24 and the transmission gear 20, a portion of the flange 24*b* of the drive shaft 24 is cut away, and the guide tube 20*b* has the same shape as the cut-away flange 24*b* for a secure engagement.

A drive shaft holder 26 is installed in the opening 12*a* of the housing 12 at a distance from the fixing frame 14. The drive shaft holder 26 is shaped in a somewhat shallow cylindrical receptacle. The upper portion of the drive shaft 24 protrudes from the bottom of this drive shaft holder 26.

A head frame 30 is fitted on the housing 12 in a detachable fashion so that the head frame 30 can cover the drive shaft holder 26. The head frame 30 is formed with three through holes 31 so that three shaving units described below are installed in these holes 31 from the inside of the housing 12.

Figure 3:
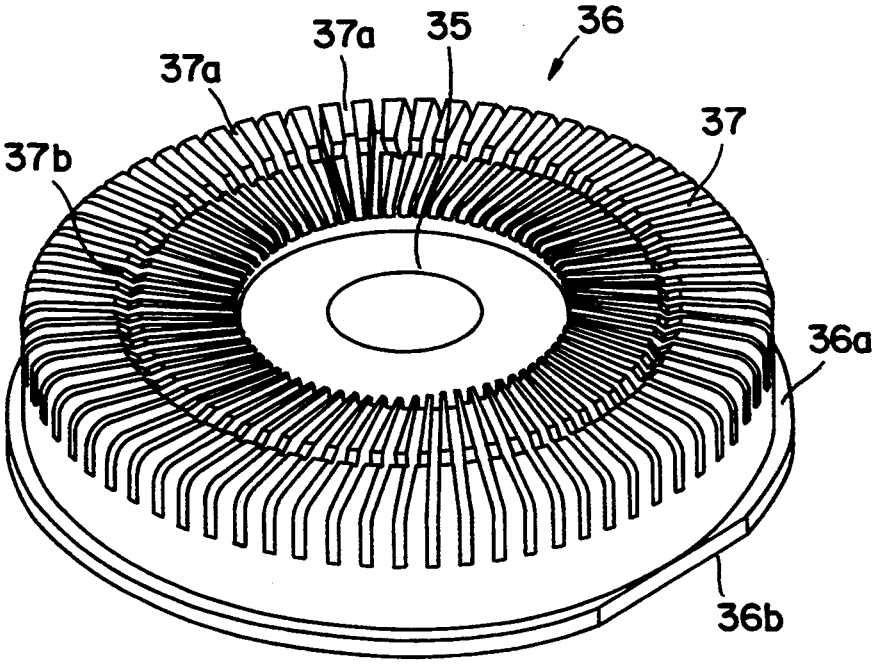
FIG. 3 is a perspective view of an outer cutter used in the razor of the present invention.

Each shaving unit 34 comprises an outer cutter 36 and an inner cutter 38. The outer cutter 36, as seen in FIG. 3, has a round shaving surface 37 on its top surface. Openings or slits 37*a* are provided in substantially a radial direction for the entire shaving surface 37. An outer cutter cap 35 is fitted in the center of the outer cutter 36. A circular guide groove 37*b* is formed at an intermediate portion of the shaving surface 37. Thus, so that the shaving surface 37 is divided into two (outside and inside) sections in the form of concentric circles. Furthermore, the outer cutter 36 has a flange 36*a* at the bottom. The upper surface of the flange 36*a* comes into contact with the under surface of the head frame 30 so that the outer cutter 36 cannot slip off. In addition, a cut-out 36*b* is formed at one part of the outer cutter 36. Thus, the outer cutter 36 is prevented from rotating by a combination of the cut-out 36*b* and a stopper (not shown) formed on the inside surface of the head frame 30.

Figure 2:
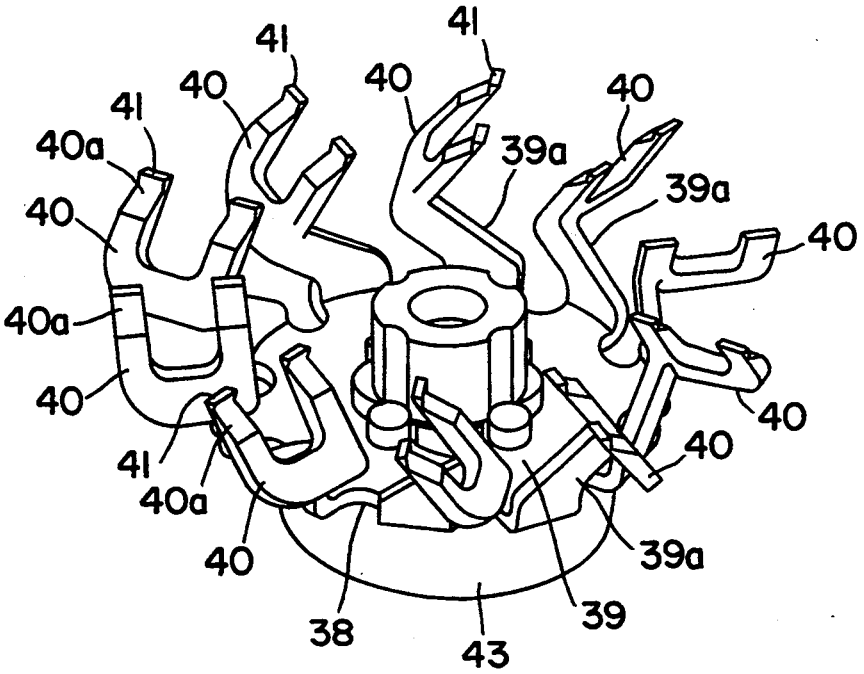
FIG. 2 is a perspective view of an inner cutter used in the razor of the present invention, the inner cutter being mounted on a transmission cylinder.

On the other hand, as seen from FIG. 2, the inner cutter 38 has a plurality of cutter arms 39*a* extending upwardly from the outer circumferential edge portion of a cutter disk 39. In other words, the arms extend in a vertical direction relative to the surface of the cutter disk 39. A cutter blade 40 is formed at the end of each one of the cutter arms 39*a*. The cutter blade 40 is inclined in the direction of rotation of the inner cutter that is shown by arrows in FIGS. 4 and 5. The cutter blades 40 slide under the outer cutter 36. The end of each one of the cutter blades 40 is split into two branches so that the two split ends are formed with cutting edge surfaces 41. The cutting edge surfaces 41 are parallel to the surface of the cutter disk 39 and fit in the two circular sections of the shaving surface 37 of the outer cutter 36.

At the center of the cutter disk 39 an engagement hole is formed, and into this engagement hole, a transmission cylinder 43, which transmits the rotation from the power source (the motor 16) to the inner cutter 38, is inserted. Thus, the inner cutter 38 and the transmission cylinder 43 form a single unit. As seen from FIG. 1, the transmission cylinder 43 has an engagement hole 43*b* in the bottom, and a transmission tongue 24*c* formed at the tip end of the drive shaft 24 is inserted into this engagement hole 43*b*. The surrounding areas of the engagement hole 43*b* are rounded to provide an easy insertion of the transmission tongue 24*c* of the drive shaft 24 into the engagement hole 43*b*.

A more detailed description of the inner cutter 38 will be made below with reference to FIGS. 2 and 4.

At the upper part of the rear surface 40*b* of the cutter blade 40, a recess 40*a* is formed. More specifically, the recess 40*a* is on the surface which faces the direction that is opposite from the direction of rotation of the inner cutter shown by the arrow in FIG. 4. The recess 40*a* is formed by cutting away a portion of the cutting edge surface 41. In particular, as seen from FIG. 4, about a rear half portion of the cutting edge surface 41 that faces the direction opposite from the direction of rotation of the inner cutter is cut out as shown by the dotted line. In other words, the dotted line represents the shape of the rear side of a conventional cutter blade. More specifically, as shown in FIG. 4, the upper portion of the recess 40*a* has an angle $\theta$ relative to the cutting edge surface 41, and this cut angle $\theta$ is 90 degrees in this embodiment. In addition, this recess 40*a* is beveled rearwardly from its middle point. With this recess 40*a*, it is difficult for the shaving debris and other substances to adhere to the recess 40*a*. In other words, shaving debris hardly adheres to the cutter blade 40.

Figure 5:
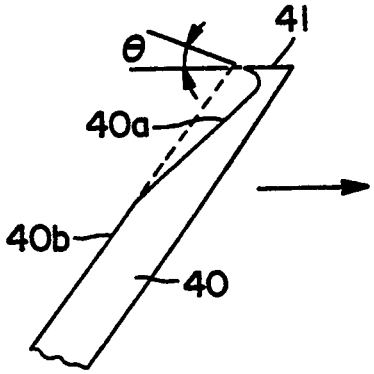
FIG. 5 is a side view of one of the cutter blades of another inner cutter used in the razor of the present invention on an enlarged scale.

If, as seen from FIG. 5, the angle $\theta$ is set to be smaller than 90 degrees, the end of the rear surface 40*b* is pointed and the recess 40*a* in a rounded concave shape, thus making it much more difficult for shaving debris and other substances to adhere to the recess 40*a*.

Figure 4:
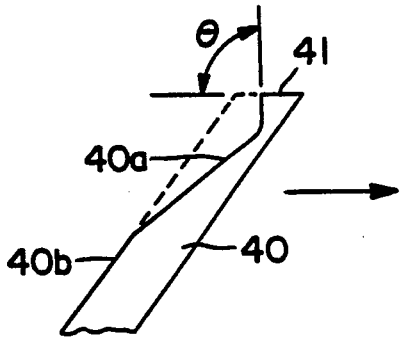
FIG. 4 is a side view of one of the cutter blades of the inner cutter used in the razor of the present invention on an enlarged scale.

In the conventional inner cutter, the angle $\theta$ is greater than 90 degrees as indicated by the dotted lines in FIGS. 4 and 5. Accordingly, the shaving debris, etc. tends to adhere to the rear surface 40*b* of the cutter blade 40.

Back to FIG. 1, the reference numeral 46 is a shaving unit retaining plate 46 which is installed on the back surface of the head frame 30. The shaving unit retaining plate 46 is fixed to the head frame 30 via a supporting shaft 48. The supporting shaft 48 has a threaded portion 48*a* at one end that is screwed into the center hole of the head frame 30. The supporting shaft 48 has a flange 48*b* at the other end, and a spring 50 is installed on the supporting shaft 48 so that it is between the flange 48*b* and the shaving unit retaining plate 46. The upper end of the supporting shaft 48 is restrained by a retaining ring 49. Thus, the shaving unit retaining plate 46 is urged upward by the spring 50.

Figure 6:
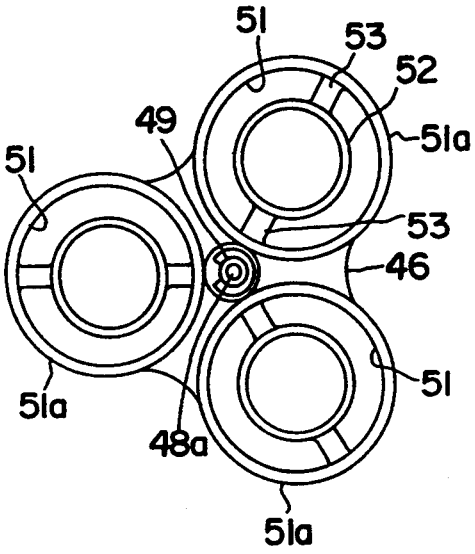
FIG. 6 is a top view of the blade-retaining plate used in the razor.
Figure 7:
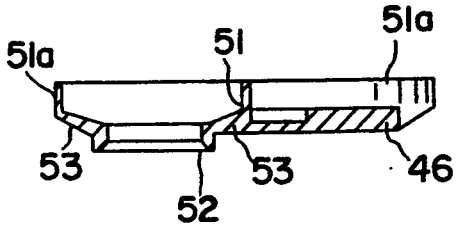
FIG. 7 is a vertical cross section thereof.
Figure 8:
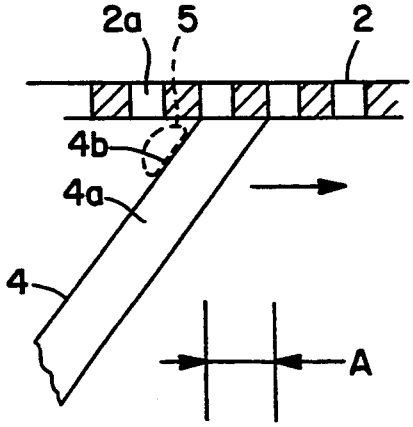
FIG. 8 PRIOR ART
FIG. 8 is an illustration showing the positional relationship between the inner and outer cutters of a prior art razor.

As seen in FIGS. 6 and 7, the shaving unit retaining plate 46 has through holes 51 which positionally correspond to the holes 31 of the head frame 30. As seen in FIG. 1, supporting tubes 51*a* project upward from the inside rims of these holes 51, and the upper ends of these supporting tubes 51*a* are in contact with the flanges 36*a* of the outer cutters 36.

When shaving is performed, the shaving surfaces 37 of the outer cutters 36 are pressed toward the inside of the razor 10 so that the outer cutters 36 are pushed inwardly against the driving force of the springs 50. Thus, shaving is performed with the razor fitting snugly on the facial contour. In addition, the drive shafts 24 that hold the transmission cylinder 43 are also supported by springs 21. Accordingly, the drive shafts 24 can move to and fro in the axial directions together with the shaving units 34.

Meanwhile, the shaving unit retaining plate 46 is further provided with a ring section 52 in each supporting part 53. The ring section 52 is supported by the drive shaft 24 so as not to come into contact with the cutter cylinder 43 during the shaving.

The shaving unit retaining plate 46 described above is attached to the back surface of the head frame 30 via the supporting shaft 48. When the head frame 30 is detached from the razor 10, the shaving units 34 stay with the shaving unit retaining plate 46 because of the ring sections 52 of the supporting tubes 51*a* of the shaving unit retaining plate 46.

The springs 21 urge the inner cutters 38 so that the cutting edge surfaces 41 of the inner cutters 38 are pressed against the inside or bottom surfaces of the outer cutters 36, thus causing whiskers to be cut by the outer cutters 36 and inner cutters 38. Accordingly, with the surface area of the cutting edge surface 41 smaller than that of conventional razors, a cutting effect equal to that obtained in the conventional razors is obtainable with the inner cutter of this invention even if the pressing force of the springs 21 is small. In other words, due to the smaller surface area of the cutting edge surfaces of the cutter blades, the pressing pressure which the inner cutters 38 apply to the outer cutters 36 can be reduced.

In use, the electric razor 10 is switched on, and shaving is performed by pressing the outer cutters 36 against the face. Whiskers penetrate the outer cutters 36 through the slits 37*a* of the shaving surface 37 and are sheared by the outer cutters 36 and the cutter blades 40 of the inner cutters 38 which are rotated by the motor 16 via the drive gear 18, the transmission gears 20 and the drive shafts 24. Since the upper ends of the supporting tubes 51*a* are in contact with the flanges 36*a* of the outer cutters 36, the sheared whiskers are guided by the supporting tubes 51*a* and drop without being scattered or coming out of the outer cutters 36 and collected in the receptacle shape drive shaft holder 26.

When whiskers are collected in the drive shaft holder 26, the head frame 30 is detached from the housing 12, and the whiskers are cleaned out of the drive shaft holder 26 by a brush or other devices. Since not much shaving debris sticks to the shaving units 34 particularly to the inner cutter as described above, there is no great need to clean the shaving units 34. If however, the shaving units 34 need to be cleaned, they can be removed from the head frame 30 by unscrewing the supporting shaft 48 and then cleaned.

In the above embodiment, the outer cutter 36 is divided into concentric circles by the circular guide groove 37*b*, and the cutter blade 40 of the inner cutter 38 are split into two branches. However, the inner cutters of the present invention which have recesses on the rear surfaces can be used in razors with outer cutters that have no guide grooves 37*b*. Also, the recesses can be formed on the rear surfaces of the cutting blade with single or non-branched cutting edge surfaces.

In addition, the front edge (and not the rear edge as in the above embodiment) of the cutting edge surface of the cutter blade can be cut out so as to reduce the overall weight of the inner cutter and to reduce the surface area which contacts the outer cutter. Also, the recesses can be formed on the front (and not on the rear) surface of the cutting blades. The same effect as in the rear recesses are obtained.

In the above, various descriptions are given based on an appropriate embodiment of the present invention. However, the present invention is not limited to the embodiment. It goes without saying that various modifications are possible within the spirit of the present invention.

According to the present invention, the electric razor includes inner cutters that have recesses on the surfaces of the cutter blades that face the direction opposite from the rotational direction of the inner cutter. Accordingly, shaving debris and other substances do not easily adhere to the Cutting blades. Thus, cleaning of the inner cutters, if necessary, can be done easily. Furthermore, since not much of the shaving debris, etc. adhere to the cutter blades, there is no increase in the weight of the inner cutters with the repeated shavings. As a result, the load on the motor can be small, and the power consumption can be small.

In addition, since the area of contact between the outer cutters and inner cutters is reduced due to the cut-out on the cutting edge surface, the cutting edge surfaces of small thickness are obtained and the overall weight of the inner cutters can be small. Also, with the reduced area of contact between the outer cutters and the inner cutters, the contact pressure of the inner cutters against the outer cutters can be small. Accordingly, a shaving effect equal to that of conventional electric razors can be obtained even if the driving force of the springs which presses the inner cutter against the outer cutter is small. Thus, the contact pressure on the outer cutters can be small and so can the load on the motor.

Accordingly, shaving debris and other substances do not easily adhere to the inner cutters, the area of contact between the inner cutters and outer cutters is small, and the overall weight of the inner cutters can be small. These result is that the power consumption of the razor is small, and in a rechargeable electric razor, the razor can work longer.

I claim:

1. An electric razor comprising:

at least one outer cutter with openings through which whiskers penetrate;

at least one inner cutter having a plurality of cutter blades, each one of said cutter blades having a cutting edge surface at an upper end thereof that slides on an inside surface of said outer cutter, said cutter blades being inclined in a direction of rotation of said inner cutter; and a recess comprising an indentation formed immediately beneath said cutting edge surface and facing in a direction opposite from said direction of rotation of said inner cutter in each one of said plurality of cutter blades whereby said cutting edge surface is made thinner than a thickness of said cutter blade.

2. An electric razor according to claim 1, wherein said inner cutter further comprises a cutter disk with a through hole at a center thereof and a plurality of cutter arms extending from an outer edge of said cutter disk in a vertical direction relative to said cutter disk and said plurality of said cutter blades extend from said cutter arms.

3. An inner cutter used in an electric rotary razor comprising:

a cutter disk with a through hole at a center thereof;

a plurality of cutter arms extending from an outer edge of said cutter disk in a vertical direction relative to said cutter disk;

a cutter blade extending from each one of said cutter arms and inclined in a rotational direction of said inner cutter, each one of said cutter blades being provided with a cutting edge surface at an end surface of said cutter blade and with a recess formed below said cutting edge surface; and wherein said recess is formed on a rear surface of said cutter blade, said rear surface facing an opposite direction from the rotational direction of said inner cutter.

* * * * *